US011724161B2

(12) United States Patent
Takubo et al.

(10) Patent No.: US 11,724,161 B2
(45) Date of Patent: Aug. 15, 2023

(54) GOLF BALL

(71) Applicant: SUMITOMO RUBBER INDUSTRIES, LTD., Hyogo (JP)

(72) Inventors: Toshiyuki Takubo, Hyogo (JP); Takahiro Sajima, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/395,558

(22) Filed: Aug. 6, 2021

(65) Prior Publication Data

US 2022/0062714 A1 Mar. 3, 2022

(30) Foreign Application Priority Data

Aug. 26, 2020 (JP) ..... 2020-142703

(51) Int. Cl.
*A63B 37/06* (2006.01)
*A63B 37/00* (2006.01)

(52) U.S. Cl.
CPC .... *A63B 37/00373* (2020.08); *A63B 37/0043* (2013.01); *A63B 37/0075* (2013.01); *A63B 37/00495* (2020.08)

(58) Field of Classification Search
CPC ..... A63B 37/0038; A63B 37/12; A63B 37/14
USPC ..... 473/373
See application file for complete search history.

(56) References Cited

U.S. PATENT DOCUMENTS 5,984,806 A * 11/1999 Sullivan ..... A63B 37/0062 473/378
6,066,054 A * 5/2000 Masutani ..... A63B 37/0003 473/377
2008/0020865 A1 1/2008 Mitsuba
2008/0248897 A1* 10/2008 Morgan ..... A63B 37/004 473/371

FOREIGN PATENT DOCUMENTS

JP 2008-22940 2/2008
JP 2009-45498 3/2009

* cited by examiner

*Primary Examiner* — Raeann Gorden
(74) *Attorney, Agent, or Firm* — Greenblum & Bernstein, P.L.C.

(57) ABSTRACT

A golf ball includes a core and a cover positioned outside the core. An n-layer (n is a natural number) partial mid layer is provided between the core and the cover. An area of the core in a region where the cover is laminated thereon is not less than 5.0% and not greater than 95.0% of a surface area of a phantom sphere having a radius equal to an average value of a distance from a central point of the core to a surface of the core. In an outer surface of the golf ball, a color difference ΔE1 based on a CIELAB color system between a region C where the cover is directly laminated on the core and a region M where the cover is laminated on the partial mid layer is not less than 20.0.

10 Claims, 3 Drawing Sheets

VI-VI cross section

II - II cross section

III - III cross section

IV - IV cross section

VI-VI cross section

GOLF BALL

CROSS-REFERENCE TO RELATED APPLICATION

This application claims priority on and the benefit of Patent Application No. 2020-142703 filed in JAPAN on Aug. 26, 2020. The entire disclosures of this Japanese Patent Application are hereby incorporated by reference.

BACKGROUND OF THE INVENTION

Field of the Invention

The present invention relates to golf balls. Specifically, the present invention relates to golf balls having layer structures.

Description of the Related Art

Upon a tee shot and upon putting, golf players desire a golf ball that is easily addressed and that can be correctly hit in a target direction.

In order to make it easy to address a golf ball, a golf player themselves may draw a desired line or the like on the surface of the golf ball. In addition, JP2008-22940 (Patent Literature 1) and JP2009-45498 (Patent Literature 2) each disclose a golf ball provided with a plurality of marks that can be visually recognized at the same time. In Patent Literatures 1 and 2, the plurality of marks are printed on the surface of the golf ball.

Upon a tee shot or upon putting, a golf player can place a golf ball such that a line or marks on the surface of the ball are directed in the intended direction. By using the line or the marks as a reference when hitting, the golf player can accurately address the golf ball for the target direction.

In play, a golf ball is hit repeatedly. A line or marks drawn or printed on the surface of the golf ball fade in color by being abraded due to collision with clubs, the ground, etc. On a golf ball that has been used over a long period of time, a necessary line or the like may disappear. A golf ball having a line or the like drawn or printed on the surface thereof does not have a sufficient function of assisting a golf player in addressing the golf ball upon a tee shot and upon putting in use after repeated hits.

Golf players also desire a golf ball whose rotation state is easily checked after being hit upon an approach shot. A golf ball that has a long-term a function of assisting a golf player in addressing the golf ball upon a tee shot and upon putting, checking the rotation state of the ball after the ball is hit, etc., has not yet been proposed.

An object of the present invention is to provide a golf ball that has a function of assisting a golf player upon various shots, such as ease of addressing the golf ball at the time of hitting and ease of checking the rotation state of the golf ball after the golf ball is hit, and that does not lose the assist function even after repeated hits.

SUMMARY OF THE INVENTION

A golf ball according to the present invention includes a core and a cover positioned outside the core. An n-layer (n is a natural number) partial mid layer is provided between the core and the cover. An area of the core in a region where the cover is laminated thereon is not less than 5.0% and not greater than 95.0% of a surface area of a phantom sphere having a radius equal to an average value of a distance from a central point of the core to a surface of the core. In an outer surface of the golf ball, a color difference ΔE1 based on a CIELAB color system between a region C where the cover is directly laminated on the core and a region M where the cover is laminated on the partial mid layer is not less than 20.0.

In the outer surface of the golf ball according to the present invention, a region having a different color tone is formed by the partial mid layer provided between the core and the cover. A golf player can visually recognize this difference in color tone. By using this region having a different color tone as a reference, the golf player can accurately address the golf ball at the time of hitting. In addition, the golf player can easily check the rotation state of the ball after hitting. Furthermore, this region having a different color tone is formed by the partial mid layer inside the cover. Therefore, the color tone that can be visually recognized by a golf player is maintained without fading even after the ball is repeatedly hit. The golf ball can exhibit a function of assisting a golf player upon each shot, over a long period of time.

Preferably, the area of the core in the region where the cover is laminated thereon is not less than 50.0% and not greater than 95.0% of the surface area of the phantom sphere having a radius equal to the average value of the distance from the central point of the core to the surface of the core.

Preferably, the partial mid layer is formed in a band shape along a great circle drawn on a surface of the phantom sphere or a small circle parallel to the great circle. A total length L1 measured when the partial mid layer is projected onto the surface of the phantom sphere is not less than 25% of a circumference of the great circle drawn on the surface of the phantom sphere. Preferably, the partial mid layer is formed in a band shape along at least two great circles drawn on the surface of the phantom sphere.

Preferably, the partial mid layer is provided such that the core and the cover are in contact with each other in a band shape along a great circle drawn on a surface of the phantom sphere or a small circle parallel to the great circle. A total length L2 measured when a region where the core and the cover are in contact with each other is projected onto the surface of the phantom sphere is not less than 25% of a circumference of the great circle drawn on the surface of the phantom sphere. Preferably, the partial mid layer is provided such that the core and the cover are in contact with each other in a band shape along at least two great circles drawn on the surface of the phantom sphere.

According to a preferred embodiment, a first partial mid layer and a second partial mid layer that have different color tones are provided between the core and the cover. In the outer surface of the golf ball, a color difference ΔE2 based on the CIELAB color system between a region M1 where the cover is laminated on the first partial mid layer and a region M2 where the cover is laminated on the second partial mid layer is less than 20.0.

According to another preferred embodiment, a first partial mid layer and a second partial mid layer that have different color tones are provided between the core and the cover. In the outer surface of the golf ball, a color difference ΔE2 based on the CIELAB color system between a region M1 where the cover is laminated on the first partial mid layer and a region M2 where the cover is laminated on the second partial mid layer is not less than 20.0.

Preferably, the core is a sphere. Preferably, the partial mid layer is disposed on a spherical surface of the core.

Preferably, the partial mid layer has a hardness equal to that of the cover.

Preferably, in the golf ball, the partial mid layer can be seen through the cover.

DESCRIPTION OF THE PREFERRED EMBODIMENTS

Figure 1:
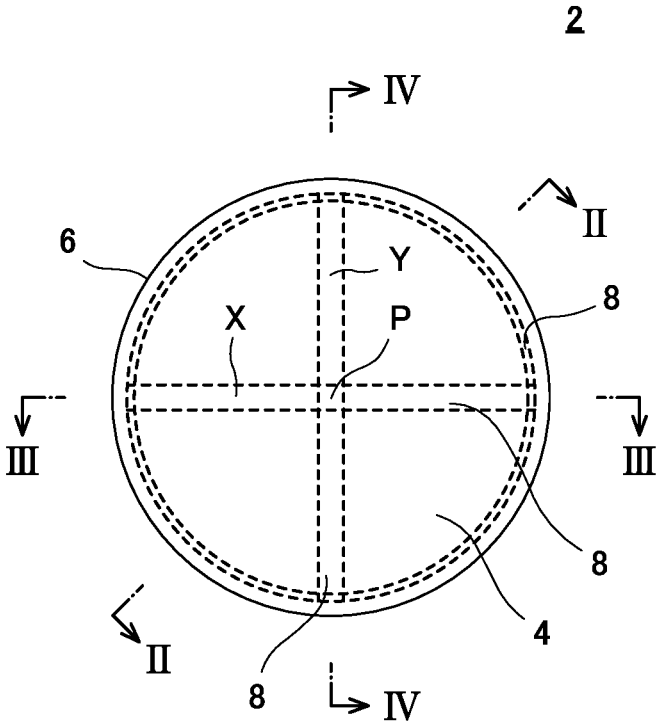
FIG. 1 is a schematic diagram showing the appearance of a golf ball according to an embodiment of the present invention.

The following will describe in detail the present invention based on preferred embodiments with appropriate reference to the drawings.

The feature of the golf ball according to the present invention is that an n-layer partial mid layer is provided between a core and a cover positioned outside the core. n is a natural number. In the specification of the present application, the term "partial mid layer" is defined as a layer that is laminated on the core and partially covers the core and on which the cover is laminated. The term "partial mid layer" in the present application is essentially different from a so-called "mid layer" that covers the entirety of the core. In the golf ball provided with the partial mid layer, a part of the cover is directly laminated on the core without the partial mid layer therebetween. The state after the partial mid layer is formed on the core and before the partial mid layer is covered with the cover is sometimes referred to as "intermediate".

In the golf ball, the ratio (hereinafter, sometimes referred to as "area %") of the area of the core in the region where the cover is directly laminated thereon, to the surface area of a phantom sphere having a radius equal to the average value of the distance from the central point of the core to the surface of the core, is not less than 5.0% and not greater than 95.0%. In the region where the cover is directly laminated on the core, the colors of the core and the cover are reflected in the surface of the golf ball. On the other hand, in the region where the cover is laminated on the partial mid layer, the colors of the partial mid layer and the cover are reflected in the surface of the golf ball. In particular, in the case where the cover has a light color or is transparent, a region in which the color of the core is reflected and a region in which the color of the partial mid layer is reflected are formed in the ball surface. In other words, the area % is the ratio of the area of the region in which the color of the core is reflected in the ball surface, to the surface area of the phantom sphere.

In the case where the area of the core in the region where the cover is directly laminated thereon satisfies the above-described numerical range with respect to the surface area of the phantom sphere having a radius equal to the average value of the distance from the central point of the core to the surface of the core, a golf player can easily and clearly see a region having a different color tone and formed on the surface of the golf ball. In addition, by using the region having a different color tone as a guide, the golf player can accurately address the golf ball upon putting, and can easily check the rotation state of the ball after hitting the ball upon an approach shot. Furthermore, in the golf ball, the region having a different color tone in the ball surface is formed by the partial mid layer inside the cover. Therefore, the color tone that can be visually recognized by a golf player can be maintained without fading even after the ball is repeatedly hit. The golf ball can exhibit a function of assisting a golf player, over a long period of time.

From the viewpoint of visibility and enhancement of the assist function, the ratio of the area of the core in the region where the cover is laminated thereon, to the surface area of the phantom sphere, is preferably not greater than 93.0% and more preferably not greater than 90.0%. From the same viewpoint, the area % is preferably not less than 7.0% and more preferably not less than 10.0%.

In this golf ball, in the case where the partial mid layer is provided between the core and the cover, it is necessary to insert the material of the partial mid layer between the core and a mold after the core is placed in the mold. Specifically, it is necessary to partially bring the core and the mold into close contact with each other, and insert the material of the partial mid layer only in the region where the core and the mold are not in close contact with each other. Here, if the region where the core and the mold are in close contact with each other is narrow, there is a possibility that the core cannot be stably held by the mold and a manufacturing failure may occur. In the region where the core and the mold are in close contact with each other, the partial mid layer is not formed, and the cover is formed directly on the core. That is, the area of the region where the core and the mold are in close contact with each other corresponds to the area of the region where the cover is directly laminated on the core. Therefore, from the viewpoint of avoiding the occurrence of a manufacturing failure, the area of the core in the region where the cover is laminated thereon (that is, the area of the region where the core and the mold are in close contact with each other) to the surface area of the phantom sphere having a radius equal to the average value of the distance from the central point of the core to the surface of the core is preferably not less than 50.0%, more preferably not less than 52.0%, and further preferably not less than 55.0%.

Moreover, in the golf ball, in the outer surface of the golf ball, a color difference ΔE1 based on the CIELAB color system between a region C where the cover is directly laminated on the core and a region M where the cover is laminated on the partial mid layer is not less than 20.0. In the golf ball in which the color difference ΔE1 is not less than 20.0, the boundary between the region C and the region M is clear. With the golf ball, a golf player can use the region M or the region C as a guide when addressing the golf ball. Furthermore, the appearance of the golf ball can give a preferable impression to the golf player. From this viewpoint, the color difference ΔE1 between the region C and the region M is preferably not less than 22.5 and more preferably not less than 25.0.

In the specification of the present application, the color difference ΔE1 is calculated by the following mathematical formula using an index "L" value, an index "a" value, and an index "b" value in the CIELAB color system.

$$\Delta E1=[(\Delta L)^2+(\Delta a)^2+(\Delta b)^2]^{1/2}$$

In the formula, "L" is an index of lightness, and "a" and "b" are indexes that correlate with hue and saturation. The indexes "L", "a", and "b" are obtained by measuring the outer surface of the golf ball using the color difference meter "CM-3500d" manufactured by KONICA MINOLTA, INC. As a light source, "standard light D65" is used. The color temperature of the light source is 6504 k. As a spectral sensitivity, a "view angle of 2°" is used. The CIELAB color system is a standard specified by the International Commission on Illumination (CIE) in 1976. In Japan, the CIELAB color system is used in "JIS Z 8729".

The color difference ΔE1 obtained by measuring the outer surface of the golf ball can be adjusted by changing the respective color tones of the core, the partial mid layer, and the cover. The colors of the core, the partial mid layer, and the cover may be uniform or non-uniform as long as the color difference ΔE1 satisfies the above-mentioned numerical range. In addition, as long as the color difference ΔE1 satisfies the above-mentioned numerical range, a plurality of partial mid layers having different color tones may be formed between the core and the cover in the golf ball.

For example, in a golf ball in which a first partial mid layer and a second partial mid layer that have different color tones are provided between a core and a cover, in the outer surface of the golf ball, a color difference ΔE2 based on the CIELAB color system between a region M1 where the cover is laminated on the first partial mid layer and a region M2 where the cover is laminated on the second partial mid layer may be less than 20.0. In the surface of the golf ball in which the color difference ΔE2 is less than 20.0, the region M1 and the region M2 having different color tones from a region C are colored in similar colors.

Moreover, in the golf ball in which the first partial mid layer and the second partial mid layer that have different color tones are provided between the core and the cover, the color difference ΔE2 may be not less than 20.0. In the surface of the golf ball in which the color difference ΔE2 is not less than 20.0, the region M1 and the region M2 having different color tones from the region C are colored in different types of color.

The golf ball in which the first partial mid layer and the second partial mid layer that have different color tones are provided between the core and the cover as described above has excellent design and can give a preferable impression to a golf player.

The following will describe the present invention by exemplifying two typical embodiments, but the present invention is not limited to the following embodiments, and various modifications can be made within the scope indicated in the claims. Other embodiments obtained by appropriately combining the technical means respectively disclosed for a plurality of embodiments are also included in the technical scope of the present invention.

First Embodiment

In a golf ball according to a first embodiment of the present invention, a partial mid layer is formed in a band shape along a great circle drawn on the surface of a phantom sphere having a radius equal to the average value of the distance from the central point of a core to the surface of the core or a small circle parallel to the great circle. In the golf ball, a region M in which the color tone of the partial mid layer is reflected is recognized by a golf player as a straight line in a plane projection view. The straight line that is visible on the surface of the golf ball is effective as a guide at the time of hitting. More preferably, the partial mid layer is formed in a band shape along at least two great circles drawn on the surface of the phantom sphere.

In the golf ball according to the first embodiment, the ratio (hereinafter, sometimes referred to as "straight line %") of a total length L1 measured when the partial mid layer is projected onto the surface of the phantom sphere, to the circumference of the great circle drawn on the surface of the phantom sphere, is preferably not less than 25%. In the golf ball in which the straight line % is not less than 25%, the line that can be recognized as a straight line is sufficiently long in the outer surface of the golf ball. The golf player can easily see this line when or after hitting. The golf ball is easily addressed at the time of hitting, and the rotation state of the ball after hitting is easily checked. From this viewpoint, the straight line % is more preferably not less than 50% and particularly preferably not less than 75%.

FIG. 1 is a schematic diagram for describing a golf ball 2 according to the first embodiment. FIG. 1 shows the appearance of the golf ball 2. The components inside the golf ball 2 are shown by broken lines. The golf ball 2 includes a core 4 and a cover 6 positioned outside the core 4. A partial mid layer 8 is provided between the core 4 and the cover 6.

Although not shown, a large number of dimples are formed on the surface of the cover 6. Of the surface of the golf ball 2, a part other than the dimples is referred to as a land. The golf ball 2 includes a paint layer and a mark layer on the external side of the cover 6, but these layers are also not shown in the drawing.

As shown, the core 4 is a sphere. In the golf ball 2, the partial mid layer 8 is formed in a band shape on the surface of the core 4 which is a sphere, and the cover 6 is laminated on the partial mid layer 8. In a region where the partial mid layer 8 is not formed, the cover 6 is directly laminated on the core 4. In the golf ball 2, the area of the core 4 in a region where the cover 6 is laminated thereon is not less than 5.0% and not greater than 95.0% of the surface area of a phantom sphere having a radius equal to the average value of the distance from the central point of the core 4 to the surface of the core 4. In the case of the core 4 which is a sphere, the area of the core 4 in the region where the cover 6 is laminated thereon is not less than 5.0% and not greater than 95.0% of the surface area of the core 4.

In the golf ball 2, the band-shaped partial mid layer 8 is formed along a great circle drawn on the surface of the above-described phantom sphere. Specifically, the partial mid layer 8 is formed in a band shape along three great circles that are drawn on the surface of the phantom sphere and orthogonal to each other. In the core 4 which is a sphere, the surface of the phantom sphere is the surface of the core 4. In the golf ball 2, the ratio (straight line %) of a total length L1 measured when the partial mid layer 8 is projected onto the surface of the phantom sphere (that is, the surface of the core 4) to the circumference of the great circle drawn on the surface of the phantom sphere is 300%.

Figure 2:
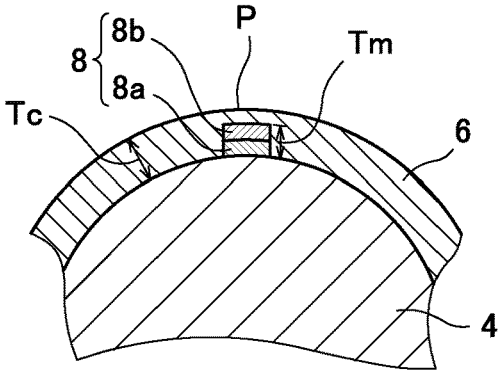
FIG. 2 is a partial cross-sectional view of the golf ball in FIG. 1 taken along a line II-II.

In FIG. 1, symbols P, X, and Y indicate points on one great circle, and the symbol P also indicates a point of intersection of the one great circle and another great circle. FIG. 2 is a partial cross-sectional view of the golf ball 2 in FIG. 1 taken along a line II-II. In FIG. 2, a double ended arrow Tm indicates the thickness (mm) of the partial mid layer 8, and a double ended arrow Tc indicates the average thickness (mm) of the cover 6. The average thickness Tc of the cover 6 is the difference (Rb−Rc) between the distance Rb (mm) from the central point of the core 4 to the outer surface of the cover 6 and an average value Rc (mm) of the distance from the central point of the core 4 to the surface of the core 4. In other words, in the core 4 which is a sphere, the average value Rc (mm) of the distance from the central point of the core 4 to the surface of the core 4 is the radius of the core 4.

As shown, in a region including the point P, the partial mid layer 8 is formed. The partial mid layer 8 has two layers (n=2), and is composed of a partial mid layer 8*a* formed along the one great circle and a partial mid layer 8*b* formed along the other great circle. In the outer surface of the golf ball 2, the color of the partial mid layer 8*b* which is an upper layer is reflected in a region M1 including the point P. The color of the core 4 is reflected in another region C where the partial mid layers 8*a* and 8*b* are not provided and the cover 6 is directly laminated on the core 4. In the golf ball 2, a color difference ΔE1 based on the CIELAB color system between the region M1 and the region C is not less than 20.0.

Figure 3:
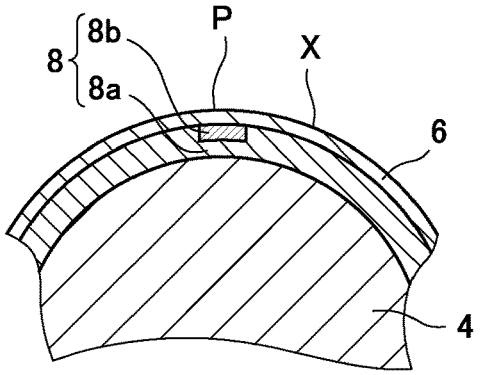
FIG. 3 is a partial cross-sectional view of the golf ball in FIG. 1 taken along a line III-III.

FIG. 3 is a partial cross-sectional view of the golf ball 2 in FIG. 1 taken along a line III-III. As shown, in the golf ball 2, the partial mid layer 8*a* is formed along the great circle including the points P and X in FIG. 1. In the region including the point P, the two-layer (n=2) partial mid layer 8 is formed as described above. The partial mid layer 8*a* formed in a region other than the region including the point P has one layer (n=1). In the outer surface of the golf ball 2, the color of the partial mid layer 8*a* is reflected in a region M2 including the point X. In the golf ball 2, a color difference ΔE1 based on the CIELAB color system between the region M2 and the region C is not less than 20.0. A color difference ΔE2 based on the CIELAB color system between the region M2 and the region M1 may be not less than 20.0 or may be less than 20.0.

Figure 4:
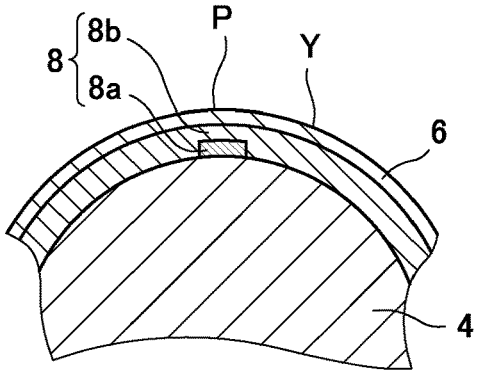
FIG. 4 is a partial cross-sectional view of the golf ball in FIG. 1 taken along a line IV-IV.

FIG. 4 is a partial cross-sectional view of the golf ball 2 in FIG. 1 taken along a line IV-IV. As shown, in the golf ball 2, the partial mid layer 8*b* is formed along the great circle including the points P and Y in FIG. 1. In the region including the point P, the above-described two-layer (n=2) partial mid layer 8 is formed. In the outer surface of the golf ball 2, the color of the partial mid layer 8*b* is reflected in the region M1 including the point Y. The color difference ΔE1 between the region M1 and the region C and the color difference ΔE2 between the region M1 and the region M2 are as described above.

The following will sequentially describe preferable configurations and materials of the core 4, the cover 6, and the partial mid layer 8, but as long as the object of the present invention is achieved, these layers may be formed from other materials, and the golf ball 2 may further include another layer.

In the golf ball 2, the core 4 may be formed from a resin composition, or may be formed from a rubber composition. Preferably, the core 4 is formed by crosslinking a rubber composition. Examples of the base rubber of the rubber composition include polybutadienes, polyisoprenes, styrene-butadiene copolymers, ethylene-propylene-diene copolymers, and natural rubbers. From the viewpoint of resilience performance, polybutadienes are preferable. Preferably, a co-crosslinking agent is used for crosslinking. Preferably, the rubber composition includes an organic peroxide together with a co-crosslinking agent.

The core 4 may be formed from a composition that includes a coloring agent. The color of the outer surface of the core 4 is adjusted by including the coloring agent. For example, in the golf ball 2 in which the cover 6 is formed to be transparent or in a light color, the color of the core 4 formed including the coloring agent is reflected in the region where the cover 6 is directly laminated on the core 4. Examples of the coloring agent include dyes and pigments. In the case where the core 4 is colored in white, a typical white coloring agent is titanium dioxide. The type and amount of the coloring agent to be included in the core 4 are selected as appropriate such that the above-described color difference ΔE1 is obtained.

As long as the advantageous effects of the present invention are not impaired, the core 4 may be formed from a composition further including additives such as a filler, sulfur, a vulcanization accelerator, a sulfur compound, an anti-aging agent, a plasticizer, a dispersant, and the like. The composition forming the core 4 may include synthetic resin powder or crosslinked rubber powder.

As long as the area % and the color difference ΔE1 satisfy the above-described numerical ranges, the core 4 is not limited to a sphere, and recesses and projections may be formed on the surface of the core 4. The recesses and projections formed on the surface of the core 4 can contribute to improvement of the degree of freedom in design by fitting the partial mid layer and the cover to each other. From the viewpoint of ease of molding, the core 4 is preferably a sphere. The core 4 may have two or more layers. In the case of a multilayer core, the materials of the respective layers may be the same or different from each other. The color of the outermost layer of the core 4 is reflected in the region where the cover 6 is directly laminated on the core 4.

As long as the advantageous effects of the present invention are achieved, the size of the core 4 is not particularly limited. In the case where the core 4 is a sphere, from the viewpoint of ease of molding and ball performance such as resilience performance and the like, the diameter of the core 4 is preferably not less than 35.0 mm and not greater than 42.0 mm. In the case where the core 4 has recesses and projections on the surface thereof, the average value Rc of the distance from the central point of the core 4 to the surface of the core 4 is preferably not less than 35.0 mm and not greater than 42.0 mm.

The difference Hs−Hc of a Shore C hardness Hs at the surface of the core 4 and a Shore C hardness Hc at the central point of the core 4 is not particularly limited, but from the viewpoint of ball performance such as resilience performance and the like, the difference Hs−Hc is preferably not less than 5, more preferably not less than 10, and further preferably not less than 20. From the viewpoint of ease of production, this difference is preferably not greater than 40.

The hardness Hs and the hardness Hc are measured with a Shore C type hardness scale mounted to an automated hardness meter (trade name "digi test II" manufactured by Heinrich Bareiss Prüfgerätebau GmbH). The hardness Hc is measured by pressing the hardness scale against the central point of the cross-section of a hemisphere obtained by cutting the golf ball 2. The hardness Hs is measured by pressing this hardness meter against the surface of the core 4. Both measurements are conducted in an environment of 23° C.

The method for producing the core 4 is not particularly limited. For example, a method is used in which the above-described rubber composition is kneaded with a known kneader (for example, a Banbury mixer, a kneader, a roll, or the like), then the obtained kneaded product is placed into a core mold, and injection molding or compression molding is performed. The temperature for crosslinking the core 4 is preferably not lower than 140° C. and not higher than 180° C. The time period for crosslinking the core 4 is preferably not shorter than 10 minutes and not longer than 60 minutes. The weight of the core 4 thus obtained is preferably not less than 10 g and not greater than 42 g.

The partial mid layer 8 is positioned outside the core 4. The partial mid layer 8 partially covers the outer surface of the core 4. In the golf ball 2, the partial mid layer 8 may be formed from a resin composition, or may be formed from a rubber composition. From the viewpoint of ease of production, the partial mid layer 8 is preferably formed from a resin composition.

A thermoplastic resin or a thermosetting resin can be used as a base resin for the partial mid layer 8. Typical resins are ionomer resins or polyurethanes. Ionomer resins are more preferable.

Specific examples of ionomer resins include: trade names "Himilan #1555", "Himilan #1557", "Himilan #1605", "Himilan #1706", "Himilan #1707", "Himilan #1856", "Himilan #1855", "Himilan AM7337", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names "Surlyn #6120", "Surlyn #6910", "Surlyn #7930", "Surlyn #7940", "Surlyn #8140", "Surlyn #8150", "Surlyn #8940", "Surlyn #8945", "Surlyn #9120", "Surlyn #9150", "Surlyn #9910", "Surlyn #9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

Preferably, the resin composition of the partial mid layer 8 further includes a styrene block-containing thermoplastic elastomer. Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Furthermore, styrene block-containing thermoplastic elastomers include a polymer alloy of an olefin and one or more members selected from the group consisting of SBS, SIS, and SIBS, and hydrogenated products thereof.

Specific examples of polymer alloys include trade names "TEFABLOC T3221C", "TEFABLOC T3339C", "TEFABLOC SJ4400N", "TEFABLOC SJ5400N", "TEFABLOC SJ6400N", "TEFABLOC SJ7400N", "TEFABLOC SJ8400N", "TEFABLOC SJ9400N", and "TEFABLOC SR04", manufactured by Mitsubishi Chemical Corporation. Other specific examples of styrene block-containing thermoplastic elastomers include trade name "Epofriend A1010" manufactured by Daicel Corporation, and trade name "SEPTON HG-252" manufactured by Kuraray Co., Ltd.

Preferably, the resin composition of the partial mid layer 8 includes a coloring agent. For example, in the golf ball 2 in which the cover 6 is formed to be transparent or in a light color, the color of the partial mid layer 8 including the coloring agent is reflected in the outer surface of the golf ball 2.

Unless the advantageous effects of the present invention are impaired, the type of the coloring agent included in the partial mid layer 8 is not particularly limited. Various coloring agents such as blue, green, purple, red, and yellow coloring agents, and the like can be used. Examples of blue coloring agents include Prussian blue, cobalt blue, phthalocyanine blue, fast sky blue, indanthrone blue BC, and the like. Examples of green coloring agents include chrome green, chromium oxide, final yellow green G, and the like. Examples of purple coloring agents include anthraquinone violet, dioxane violet, methyl violet, manganese purple, and the like. Examples of red coloring agents include red iron oxide, red lead, molybdenum red, cadmium red, pigment red, and the like. Examples of yellow coloring agents include chrome yellow, zinc yellow, cadmium yellow, yellow iron oxide, mineral fast yellow, nickel titanium yellow, and the like. The coloring agent may be a fluorescent coloring agent or a non-fluorescent coloring agent. Dyes and pigments can be used. Two or more coloring agents may be used in combination.

The resin composition of the partial mid layer 8 may include a white coloring agent such as titanium dioxide and the like. Preferably, the white coloring agent is used in combination with the above-described coloring agent. A partial mid layer 8 having a desired color can be obtained by using the white coloring agent and another coloring agent in combination.

The type and amount of the coloring agent to be included in the partial mid layer 8 are selected as appropriate such that the above-described color difference $\Delta E1$ is obtained. Unless the advantageous effects of the present invention are impaired, the resin composition forming the partial mid layer 8 may include a filler, a dispersant, an antioxidant, an ultraviolet absorber, a light stabilizer, a fluorescent material, a fluorescent brightener, and the like in an adequate amount.

In the first embodiment, as long as the area % and the color difference $\Delta E1$ satisfy the above-described numerical ranges, the shape and the number of partial mid layers 8 are not particularly limited. One partial mid layer 8 may be formed so as to partially cover the core 4, or two or more partial mid layers 8 partially covering the core 4 may be formed without being in contact with each other. For example, a plurality of partial mid layers 8 may be formed in a band shape along a great circle drawn on the surface of the golf ball 2 and a plurality of circles parallel to the great circle. In addition, a partial mid layer 8 may be formed in a band shape along three great circles that are drawn on the surface of the golf ball 2 and orthogonal to each other as shown in FIG. 1, may be formed in a band shape along two great circles randomly selected from among these three great circles, or may be formed in a band shape along one great circle randomly selected from among these three great circles. From the viewpoint of ease of production and durability to breakage, the partial mid layer 8 laminated on the core 4 is preferably connected integrally.

Moreover, in the case where the partial mid layer 8 is formed in a band shape as shown in FIG. 1, a width h of the band shape is adjusted as appropriate such that the area % satisfies the above-described numerical range. From the viewpoint of easily obtaining an appropriate area %, the width h is preferably not less than 0.5 mm and not greater than 10.0 mm.

The method for forming the partial mid layer 8 on the core 4 is not particularly limited, and known methods such as injection molding, compression molding, and the like can be used. An example of the method is as follows. A mold that includes upper and lower mold halves each having a substantially hemispherical cavity having a projection formed on an inner wall thereof, is prepared, and the core 4 is placed in the mold such that the projection on the cavity inner wall is in close contact with the surface of the core 4. Thereafter, the resin composition of the partial mid layer 8 heated at a predetermined temperature is injection-molded around the core 4.

As long as the advantageous effects of the present invention are achieved, a thickness Tm of the partial mid layer 8 is not particularly limited. From the viewpoint of ease of molding, the thickness Tm is preferably not less than 0.25 mm, more preferably not less than 0.50 mm, and further preferably not less than 0.70 mm. From the viewpoint of forming a cover having an appropriate thickness and improving durability to breakage, the thickness Tm is preferably not greater than 2.70 mm, more preferably not greater than 2.50 mm, and further preferably not greater than 2.30 mm. The thickness Tm of the partial mid layer 8 is measured on a cross-section obtained by cutting the golf ball along a plane passing through the central point of the golf ball.

The partial mid layer 8 may be formed of a single layer or may be formed of two or more layers. In the case where the partial mid layer 8 is formed of two or more layers, the color of the outermost layer of the partial mid layer 8 is reflected in the region where the cover 6 is laminated on the partial mid layer 8. In the partial mid layer 8 formed of two or more layers, the thicknesses of the respective layers may be equal to each other or different from each other. The sum of the thicknesses of the respective layers is preferably in the above-described numerical range.

The Shore D hardness of the partial mid layer 8 is not particularly limited, but, from the viewpoint of durability, the Shore D hardness is preferably not less than 30, more preferably not less than 32, and further preferably not less than 34. From the viewpoint of feel at impact, the Shore D hardness of the partial mid layer 8 is preferably not greater than 70, more preferably not greater than 68, and further preferably not greater than 66. In the case where the partial mid layer 8 is formed of two or more layers, the Shore D hardnesses of the respective layers may be equal to each other, or may be different from each other. From the viewpoint of ease of molding, a partial mid layer 8 having layers whose Shore D hardnesses are equal to each other is preferable.

The hardness of the partial mid layer 8 is measured according to the standards of "ASTM-D 2240-68". The hardness of the partial mid layer 8 is measured with a Shore D type hardness scale mounted to an automated hardness meter (trade name "digi test II" manufactured by Heinrich Bareiss Prüfgerätebau GmbH). For the measurement, a sheet that is formed by hot press, is formed from the same material as that of the partial mid layer 8, and has a thickness of about 2 mm is used. Prior to the measurement, a sheet is kept at 23° C. for two weeks. At the time of measurement, three sheets are stacked.

Preferably, the cover 6 is formed from a resin composition. Examples of the base resin of the resin composition of the cover 6 include ionomer resins, polystyrenes, polyesters, polyamides, polyolefins, and polyurethanes. The base resin is preferably an ionomer resin. The ionomer resin described above for the partial mid layer 8 can be used. For the cover 6, an ionomer resin and another resin may be used in combination.

The resin composition of the cover 6 may include a coloring agent. However, from the viewpoint of easily obtaining a desired color difference ΔE1, the cover 6 is preferably formed to be transparent or in a light color. In the golf ball 2, the color of the partial mid layer 8 is reflected in the surface of the golf ball 2. A golf ball 2 that allows a golf player to see the partial mid layer 8 through the cover 6 is particularly preferable. In such a golf ball 2, a golf player can directly use the partial mid layer 8 as a guide when or after hitting. The golf ball 2 can exhibit an excellent assist function. As long as the advantageous effects of the present invention are not impaired, the resin composition of the cover 6 may further include a filler, a dispersant, an antioxidant, an ultraviolet absorber, a light stabilizer, a fluorescent material, a fluorescent brightener, and the like.

The method for forming the cover 6 on an intermediate consisting of the core 4 and the partial mid layer 8 is not particularly limited, and known methods such as injection molding, compression molding, and the like can be used. Normally, during molding of the cover 6, dimples are formed by pimples formed on the cavity face of a mold.

The average thickness Tc of the cover 6 is not particularly limited as long as the advantageous effects of the present invention are achieved, and the average thickness Tc is adjusted as appropriate such that the above-described color difference ΔE1 is in a predetermined range. In the specification of the present application, the average thickness Tc of the cover 6 is represented as the difference (Rb−Rc) between a distance Rb from the central point of the core 4 to the outer surface of the cover 6 and an average value Rc of the distance from the central point of the core 4 to the surface of the core 4. From the viewpoint of durability, the average thickness Tc of the cover 6 is preferably not less than 0.25 mm, more preferably not less than 0.50 mm, and further preferably not less than 0.70 mm. From the viewpoint of easily obtaining a desired color difference ΔE1, the average thickness Tc of the cover 6 is preferably not greater than 3.0 mm, more preferably not greater than 2.8 mm, and further preferably not greater than 2.6 mm. The average thickness Tc of the cover 6 is obtained from the distance Rb and the average value Rc that are measured on a cross-section obtained by cutting the golf ball 2 along a plane passing through the central point of the golf ball 2. The distance Rb from the central point of the core 4 to the outer surface of the cover 6 is measured in a region where no dimple is formed on the outer surface of the cover 6.

Preferably, the thickness Tm of the above-described partial mid layer 8 is smaller than the average thickness Tc of the cover 6. From the viewpoint of ease of molding and durability, the difference Tc−Tm between the average thickness Tc of the cover 6 and the thickness Tm of the partial mid layer 8 is preferably not less than 0.25 mm, more preferably not less than 0.40 mm, and further preferably not less than 0.50 mm. The difference Tc−Tm is preferably not greater than 2.00 mm.

A thickness $T_0$ of the cover 6 laminated on the partial mid layer 8 is also not particularly limited, and is adjusted as appropriate such that the above-described color difference ΔE1 is in a predetermined range. From the viewpoint of durability, the thickness $T_0$ of the cover 6 laminated on the partial mid layer 8 is preferably not less than 0.25 mm, more preferably not less than 0.50 mm, and further preferably not less than 0.70 mm. From the viewpoint of easily obtaining a desired color difference ΔE1, the thickness $T_0$ is preferably not greater than 2.75 mm, more preferably not greater than 2.50 mm, and further preferably not greater than 2.30 mm. The thickness $T_0$ of the cover 6 is measured at a position immediately below a land. In the golf ball 2, the thickness $T_0$ of the cover 6 laminated on the partial mid layer 8 may be uniform over the entire ball or may vary. In the case where the thickness $T_0$ of the cover 6 varies, the measurement value obtained when the partial mid layer 8 provided on the core 4 is randomly selected is preferably in the above numerical range.

The Shore D hardness of the cover 6 is not particularly limited, but, from the viewpoint of durability, the Shore D hardness is preferably not less than 30, more preferably not less than 32, and further preferably not less than 34. From the viewpoint of obtaining soft feel at impact upon putting, the Shore D hardness is preferably not greater than 70, more preferably not greater than 68, and further preferably not greater than 66. The hardness of the cover 6 is measured by the same method as described above for the Shore D hardness of the partial mid layer 8.

Preferably, the compositions of the partial mid layer 8 and the cover 6 are adjusted such that the hardness of the partial mid layer 8 and the hardness of the cover 6 are equal to each other. In the golf ball 2 in which the partial mid layer 8 and the cover 6 have the same hardness, the effect that the initial conditions are not changed even when the golf ball 2 is hit with various clubs is achieved.

The golf ball 2 preferably has a diameter from 40 mm to 45 mm. From the viewpoint of conformity to the rules established by the United States Golf Association (USGA), the diameter is particularly preferably not less than 42.67 mm. From the viewpoint of suppression of air resistance, the diameter is more preferably not greater than 44 mm and particularly preferably not greater than 42.80 mm. The golf ball 2 preferably has a weight of not less than 40 g and not greater than 50 g. From the viewpoint of attainment of great inertia, the weight is more preferably not less than 44 g and particularly preferably not less than 45.00 g. From the viewpoint of conformity to the rules established by the USGA, the weight is particularly preferably not greater than 45.93 g.

From the viewpoint of feel at impact, the golf ball 2 has an amount of compressive deformation of preferably not less than 1.85 mm, more preferably not less than 2.15 mm, and particularly preferably not less than 2.30 mm. From the viewpoint of resilience performance, the amount of compressive deformation is preferably not greater than 4.85 mm, more preferably not greater than 4.55 mm, and particularly preferably not greater than 4.40 mm. For measurement of the amount of compressive deformation, a YAMADA type compression tester is used. In the tester, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured as the amount of compressive deformation.

Second Embodiment

In a golf ball according to a second embodiment of the present invention, a partial mid layer is provided such that a core and a cover are in contact with each other in a band shape along a great circle drawn on the surface of a phantom sphere having a radius equal to the average value of the distance from the central point of a core to the surface of the core or a small circle parallel to the great circle. In the golf ball, a region C in which the color tone of the core is reflected is recognized by a golf player as a straight line in a plane projection view. The straight line that is visible on the surface of the golf ball is effective as a guide at the time of hitting. More preferably, the partial mid layer is provided such that the core and the cover are in contact with each other in a band shape along at least two great circles drawn on the surface of the phantom sphere.

In the golf ball according to the second embodiment, the ratio ("straight line %") of a total length L2 measured when a band-shaped region where the core and the cover are in contact with each other is projected onto the surface of the phantom sphere, to the circumference of the great circle drawn on the surface of the phantom sphere, is preferably not less than 25%. In the golf ball in which the straight line % is not less than 25%, the line that can be recognized as a straight line is sufficiently long in the outer surface of the golf ball. The golf player can easily see this line when or after hitting. The golf ball is easily addressed at the time of hitting, and the rotation state of the ball after hitting is easily checked. From this viewpoint, the straight line % is more preferably not less than 50% and particularly preferably not less than 75%.

Figure 5:
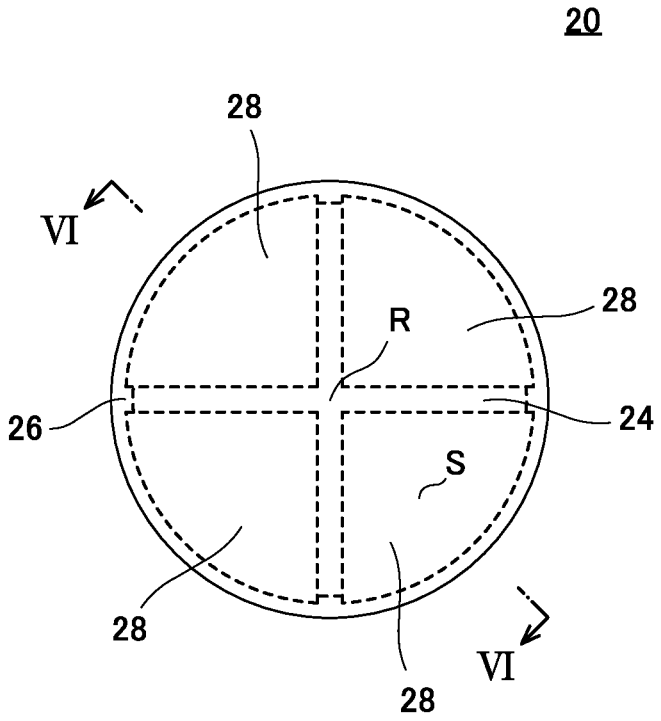
FIG. 5 is a schematic diagram showing the appearance of a golf ball according to another embodiment of the present invention.

FIG. 5 is a schematic diagram for describing a golf ball 20 according to the second embodiment of the present invention. FIG. 5 shows the appearance of the golf ball 20. The components inside the golf ball 20 are shown by broken lines. The golf ball 20 includes a core 24 and a cover 26 positioned outside the core 24. A partial mid layer 28 is provided between the core 24 and the cover 26.

Although not shown, a large number of dimples are formed on the surface of the cover 26. Of the surface of the golf ball 20, a part other than the dimples is referred to as a land. The golf ball 20 includes a paint layer and a mark layer on the external side of the cover 26, but these layers are also not shown in the drawing.

As shown, the core 24 is a sphere. In the golf ball 20, the partial mid layer 28 is formed on the surface of the core 24 which is a sphere, and the cover 26 is laminated on the partial mid layer 28. In a band-shaped region where the partial mid layer 28 is not formed, the cover 26 is directly laminated on the core 24. In the golf ball 20, the area of the core 24 in a region where the cover 26 is laminated thereon is not less than 5.0% and not greater than 95.0% of the surface area of a phantom sphere having a radius equal to the average value of the distance from the central point of the core 24 to the surface of the core 24. In the case of the core 24 which is a sphere, the area of the core 24 in the region where the cover 26 is laminated thereon is not less than 5.0% and not greater than 95.0% of the surface area of the core 24.

In the golf ball 20, the partial mid layer 28 is provided such that the core 24 and the cover 26 are in contact with each other in a band shape along a great circle drawn on the surface of the above-described phantom sphere. Specifically, the partial mid layer 28 is formed such that the core 24 and the cover 26 are in contact with each other in a band shape along three great circles that are drawn on the surface of the phantom sphere and orthogonal to each other. In the core 24 which is a sphere, the surface of the phantom sphere is the surface of the core 24. In the golf ball 20, the ratio (straight line %) of a total length L2 measured when the band-shaped region where the core 24 and the cover 26 are in contact with each other is projected onto the surface of the phantom sphere (that is, the surface of the core 24) to the circumference of the great circle drawn on the surface of the phantom sphere is 300%.

Figure 6:
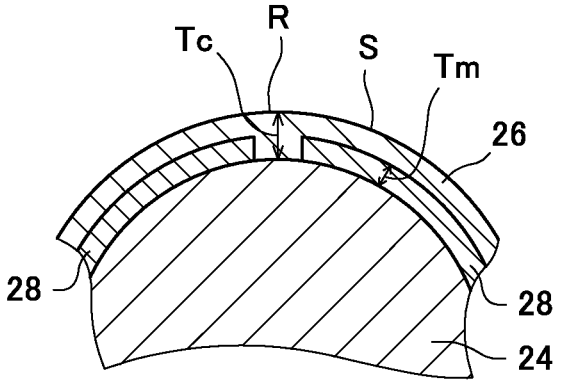
FIG. 6 is a partial cross-sectional view of the golf ball in FIG. 5 taken along a line VI-VI.

In FIG. 5, a symbol R indicates a point of intersection of one great circle and another great circle, and a symbol S indicates a point located in a region where the partial mid layer 28 is provided. FIG. 6 is a partial cross-sectional view of the golf ball 20 in FIG. 5 taken along a line VI-VI. In FIG. 6, a double ended arrow Tm indicates the thickness (mm) of the partial mid layer 28, and a double ended arrow Tc indicates the average thickness (mm) of the cover 26. The average thickness Tc of the cover 26 is defined as the difference (Rb−Rc) between a distance Rb (mm) from the central point of the core 24 to the outer surface of the cover 26 and an average value Rc (mm) of the distance from the central point of the core 24 to the surface of the core 24. In other words, in the core 24 which is a sphere, the average value Rc (mm) of the distance from the central point of the core 24 to the surface of the core 24 is the radius of the core 24.

As shown, in the golf ball 20, the partial mid layer 28 is not formed in a region including the point R. In this region, the cover 26 is directly laminated on the core 24. In a region M including the point S, the one-layer (n=1) partial mid layer 28 is provided between the core 24 and the cover 26. In the outer surface of the golf ball 20, the color of the partial mid layer 28 is reflected in the region M including the point S. The color of the core 24 is reflected in a region C where the partial mid layer 28 is not provided and the cover 26 and the core 24 are in contact with each other in a band shape. In the golf ball 20, a color difference ΔE1 based on the CIELAB color system between the region M and the region C is not less than 20.0.

In the second embodiment, as long as the area % and the color difference ΔE1 satisfy the above-described numerical ranges, the shape of the region where the partial mid layer 28 is not formed and the cover 26 is directly laminated on the core 24 is not particularly limited. For example, the partial mid layer 28 may be formed such that the cover 26 is directly laminated on the core 24 in a plurality of band-shaped regions along a great circle drawn on the surface of the golf ball 20 and a plurality of small circles parallel to the great circle. In addition, the partial mid layer 28 may be formed such that the core 24 and the cover 26 are in contact with each other in a band shape along three great circles that are drawn on the surface of the golf ball 20 and orthogonal to each other as shown in FIG. 5, may be formed such that the core 24 and the cover 26 are in contact with each other in a band shape along two great circles randomly selected from among these three great circles, or may be formed such that the core 24 and the cover 26 are in contact with each other in a band shape along one great circle randomly selected from among these three great circles.

Moreover, in the case where the core 24 and the cover 26 are formed so as to be in contact with each other in a band shape as shown in FIG. 5, the width of the region having the band shape is adjusted as appropriate such that the area % satisfies the above-described numerical range. From the viewpoint of easily obtaining an appropriate area %, the width is preferably not less than 0.5 mm and not greater than 10.0 mm.

For preferable configurations and materials of the core 24, the partial mid layer 28, and the cover 26, the configurations and the materials described above in the first embodiment can be applied. The following will describe configurations and materials different from those in the first embodiment.

In the golf ball 20, the core 24 may be formed from a resin composition, or may be formed from a rubber composition. In the second embodiment, the core 24 may be formed from a composition that includes a coloring agent. The color of the outer surface of the core 24 is adjusted by including the coloring agent. For example, in the golf ball 20 in which the cover 26 is formed to be transparent or in a light color, the color of the core 24 formed including the coloring agent is reflected in the region where the cover 26 is directly laminated on the core 24. In the case where the core 24 is colored in white, a typical white coloring agent is titanium dioxide. The coloring agent described above for the partial mid layer 8 of the first embodiment may be included in the core 24. This coloring agent and a white coloring agent may be used in combination. A core 24 having a desired color can be obtained by using a white coloring agent and another coloring agent in combination. The type and amount of the coloring agent to be included in the core 24 are selected as appropriate such that the above-described color difference ΔE1 is obtained.

In the golf ball 20, the partial mid layer 28 may be formed from a resin composition, or may be formed from a rubber composition. Preferably, the partial mid layer 8 is formed from a composition that includes a coloring agent. For example, in the golf ball 20 in which the cover 26 is formed to be transparent or in a light color, the color of the partial mid layer 28 including the coloring agent is reflected in the outer surface of the golf ball 20. The coloring agent described above in the first embodiment can be used for coloring the partial mid layer 28.

The composition of the partial mid layer 28 may include a white coloring agent such as titanium dioxide and the like. In the second embodiment, in the case where the core 24 is colored in a color other than white, from the viewpoint of visibility, the partial mid layer 28 is preferably colored in white. Accordingly, the band-shaped region where the cover 26 is laminated on the core 24 can be visually recognized as a colored line. The type and amount of the coloring agent to be included in the partial mid layer 28 are selected as appropriate such that the above-described color difference ΔE1 is obtained.

In the golf ball 20, the partial mid layer 28 is positioned outside the core 24. In the golf ball 20, a part of the outer surface of the core 24 is not covered with the partial mid layer 28. The partial mid layer 28 may be formed from a resin composition, or may be formed from a rubber composition. From the viewpoint of ease of production, the partial mid layer 28 is preferably formed from a resin composition. The resin composition described above in the first embodiment can be used.

In the second embodiment, as long as the area % and the above-described color difference ΔE1 satisfy the above-described numerical ranges, the shape of the region where the partial mid layer 28 is not formed and the cover 26 is directly laminated on the core 24 is not particularly limited. For example, the partial mid layer 28 may be formed such that the cover 26 is directly laminated on the core 24 in a plurality of band-shaped regions along a great circle drawn on the surface of the golf ball 20 and a plurality of small circles parallel to the great circle. In addition, the partial mid layer 28 may be formed such that the core 24 and the cover 26 are in contact with each other in a band shape along three great circles that are drawn on the surface of the golf ball 20 and orthogonal to each other as shown in FIG. 5, may be formed such that the core 24 and the cover 26 are in contact with each other in a band shape along two great circles randomly selected from among these three great circles, or may be formed such that the core 24 and the cover 26 are in contact with each other in a band shape along one great circle randomly selected from among these three great circles.

Moreover, in the case where the core 24 and the cover 26 are formed so as to be in contact with each other in a band shape as shown in FIG. 5, the width of the region having the band shape is adjusted as appropriate such that the area % satisfies the above-described numerical range. From the viewpoint of easily obtaining an appropriate area %, the width is preferably not less than 0.5 mm and not greater than 10.0 mm.

For a preferable mode of the cover 26 and preferable physical properties of the golf ball 20 according to the second embodiment, the contents described above in the first embodiment are applied.

EXAMPLES

The following will show the advantageous effects of the present invention by means of Examples, but the present invention should not be construed in a limited manner on the basis of the description of these Examples.

Example 1

A rubber composition R1 was obtained by kneading 100 parts by weight of a high-cis polybutadiene (trade name "BR-730", manufactured by JSR Corporation), 35.0 parts by weight of zinc diacrylate (trade name "SANCELER SR", manufactured by SANSHIN CHEMICAL INDUSTRY CO., LTD.), 5 parts by weight of zinc oxide (trade name "Zinc Oxide", manufactured by Mitsui Mining & Smelting Co., Ltd.), 11 parts by weight of barium sulfate (trade name "Barium Sulfate BD", manufactured by Sakai Chemical Industry Co., Ltd.), 0.5 parts by weight of diphenyl disulfide (manufactured by Sumitomo Seika Chemicals Co., Ltd.), 0.9 parts by weight of dicumyl peroxide (trade name "PER-CUMYL D", manufactured by NOF Corporation), and 5 parts by weight of titanium dioxide (trade name "TIPAQUE A-220", manufactured by ISHIHARA SANGYO KAISHA, LTD.). This rubber composition R1 was placed into a mold including upper and lower mold halves each having a hemispherical cavity, and heated at 170° C. for 18 minutes to obtain a white spherical core (diameter: 38.7 mm).

A red resin composition Q1 having a Shore D hardness of 57 was obtained by kneading 47 parts by weight of an ionomer resin (the aforementioned "Himilan #1555"), 46 parts by weight of another ionomer resin (the aforementioned "Himilan #1557"), 7 parts by weight of a styrene block-containing thermoplastic elastomer (the aforementioned "TEFABLOC T3221C"), 1 part by weight of a coloring agent (trade name "FP113", manufactured by Ukseung Chemical Co., Ltd.), and 0.2 parts by weight of a light stabilizer (trade name "JF-90", manufactured by Johoku Chemical Co., Ltd.) with a twin-screw kneading extruder.

Next, a mold that includes upper and lower mold halves each having a substantially hemispherical cavity was prepared. The cavity had grooves formed with a uniform depth on a wall surface thereof along three great circles that are drawn on the surface of a sphere formed when the upper and lower mold halves are combined and that are orthogonal to each other. The obtained core was placed in the mold, and then the resin composition Q1 was injected into the grooves of the cavity, thereby forming a band-shaped partial mid layer (circumferential band) having a thickness of 1.0 mm and a width of 4.0 mm. This partial mid layer was composed of one layer, and was formed along three great circles that are drawn on the surface of the core and orthogonal to each other.

A resin composition P1 having a Shore D hardness of 57 was obtained by kneading 47 parts by weight of an ionomer resin (the aforementioned "Himilan #1555"), 46 parts by weight of another ionomer resin (the aforementioned "Himilan #1557"), 7 parts by weight of a styrene block-containing thermoplastic elastomer (the aforementioned "TEFABLOC T3221C"), and 0.2 parts by weight of a light stabilizer (the aforementioned "JF-90") with a twin-screw kneading extruder.

An intermediate consisting of the core and the partial mid layer was placed into a mold that includes upper and lower mold halves each having a substantially hemispherical cavity. The intermediate was covered with the resin composition P1 by injection molding to form a transparent cover. The thickness of the cover laminated on the core was 2.0 mm. The thickness of the cover laminated on the partial mid layer was 1.0 mm. On the cover, dimples having a shape that is the inverted shape of pimples were formed.

A clear paint including a two-component curing type polyurethane as a base material was applied to this cover to obtain a golf ball of Example 1 having a diameter of about 42.7 mm and a weight of about 45.5 g. In the surface of the golf ball, a region M in which the color of the partial mid layer is reflected and a region C in which the color of the core is reflected were formed. "L" values, "a" values, and "b" values of the region C and the region M were measured by the above-described method, and a color difference ΔE1 between the region C and the region M was calculated. The obtained results are shown in Table 1 below.

Examples 2, 3, 7, 9 to 12, 14, and 15 and Comparative Examples 1, 2, and 4

Golf balls of Examples 2, 3, 7, 9 to 12, 14, and 15 and Comparative Examples 1, 2, and 4 were obtained in the same manner as Example 1, except the specifications of the core and the partial mid layer were as shown in Tables 3 to 7 below. The details of the rubber composition of the core are shown in Table 1 below. The details of the resin composition of the partial mid layer are shown in Table 2 below. In Tables 3 to 7 below, the width h shown for each of Examples 2, 3, 7, 9 to 12, 14, and 15 and Comparative Examples 1, 2, and 4 is the width (mm) of the partial mid layer formed in a band shape, and the straight line % shown therefor is the ratio (%) of the total length measured when the partial mid layer was projected onto the surface of the core to the circumference of the great circle of the core.

Example 4

A white spherical core having a diameter of 38.7 mm and a resin composition Q1 having a Shore D hardness of 57 were prepared in the same manner as Example 1. Subsequently, a pink resin composition Q2 having a Shore D hardness of 57 was obtained by kneading 47 parts by weight of an ionomer resin (the aforementioned "Himilan #1555"), 46 parts by weight of another ionomer resin (the aforementioned "Himilan #1557"), 7 parts by weight of a styrene block-containing thermoplastic elastomer (the aforementioned "TEFABLOC T3221C"), 10 parts by weight of a coloring agent (trade name, "PE-RM 18Q8863", manufactured by Dainichiseika Color & Chemicals Mfg. Co., Ltd.), 0.1 parts by weight of titanium dioxide (the aforementioned "TIPAQUE A-220"), and 0.2 parts by weight of a light stabilizer (the aforementioned "JF-90") with a twin-screw kneading extruder.

Next, a mold that includes upper and lower mold halves each having a substantially hemispherical cavity was prepared. The cavity had grooves formed with a uniform depth on a wall surface thereof along two great circles that are drawn on the surface of a sphere formed when the upper and lower mold halves are combined and that are orthogonal to each other. The obtained core was placed in the mold, and then the resin composition Q1 was put into one groove formed on the cavity. Thereafter, the resin composition Q2 was injected into the other one groove, thereby forming partial mid layers each having a width of 4.0 mm.

On the core, a first partial mid layer made of the resin composition Q1 was formed along one great circle drawn on the spherical surface of the core, and a second partial mid layer made of the resin composition Q2 was formed along another great circle orthogonal to the great circle. In a region where the first partial mid layer and the second partial mid layer intersect each other, two layers (n=2) in which the second partial mid layer having a thickness of 0.5 mm is laminated on the first partial mid layer having a thickness of 0.5 mm, were formed. The thicknesses of the first and second partial mid layers in a region where both layers do not intersect each other were each 1.0 mm.

Next, a resin composition P1 having a Shore D hardness of 57 was prepared in the same manner as Example 1, and an intermediate consisting of the core and the partial mid layer was covered with this resin composition P1 by injection molding to form a transparent cover. The average thickness of the cover was 2.0 mm. The thicknesses of the cover laminated on the first and second partial mid layers were each 1.00 mm.

A clear paint including a two-component curing type polyurethane as a base material was applied to this cover to obtain a golf ball of Example 4 having a diameter of about 42.7 mm and a weight of about 45.5 g. The details of the rubber composition of the core are shown in Table 1 below. The details of the resin composition of the partial mid layer are shown in Table 2 below. In the surface of the golf ball, a region M1 in which the color of the first partial mid layer is reflected, a region M2 in which the color of the second partial mid layer is reflected, and a region C in which the color of the core is reflected were formed. In a region where the first partial mid layer and the second partial mid layer intersect each other, the color of the first partial mid layer forming an upper layer was reflected. "L" values, "a" values, and "b" values of the region C, the region M1, and the region M2 were measured by the above-described method, and color differences ΔE1 between the region C and the regions M1 and M2 were calculated. Thereafter, a color difference ΔE2 between the region M1 and the region M2 was calculated. The obtained results are shown in Table 4 below. In Table 4, the width h shown for Example 4 is the width (mm) of each partial mid layer formed in a band shape, and the straight line % shown therefor is the ratio (%) of the total length measured when each of the first and second partial mid layers was projected onto the surface of the core to the circumference of the great circle of the core.

Example 5

A golf ball of Example 5 was obtained in the same manner as Example 4, except the specifications of the partial mid layer was as shown in Table 4 below. The details of the rubber composition of the core are shown in Table 1 below. The details of the resin composition of the partial mid layer are shown in Table 2 below. In Table 4 below, the width h shown for Example 5 is the width (mm) of the partial mid layer formed in a band shape, and the straight line % shown therefor is the ratio (%) of the total length measured when the partial mid layer was projected onto the surface of the core to the circumference of the great circle of the core.

Example 6

A white spherical core having a diameter of 38.7 mm and a resin composition Q1 and a resin composition P1 each having a Shore D hardness of 57 were prepared in the same manner as Example 1.

Next, a mold that includes upper and lower mold halves each having a substantially hemispherical cavity was prepared. The cavity had projections formed with a uniform height on a wall surface thereof along three great circles that are drawn on the surface of a sphere formed when the upper and lower mold halves are combined and that are orthogonal to each other. The obtained core was placed in the mold, and then the resin composition Q1 was injected into a portion other than the projections of the cavity, thereby forming a partial mid layer having a thickness of 1.0 mm. The partial mid layer was composed of one layer, and was formed such that the surface of the core was exposed in a band shape with a width of 4.0 mm along three great circles that are drawn on the spherical surface of the core and orthogonal to each other.

Subsequently, an intermediate consisting of the core and the partial mid layer was covered with the prepared resin composition P1 by injection molding, thereby forming a transparent cover. The cover was formed such that the cover was directly laminated on the core in a band-shaped region having a width of 4.0 mm and formed along the three great circles that are drawn on the spherical surface of the core and orthogonal to each other. The average thickness of the cover was 2.0 mm. The thickness of the cover laminated on the partial mid layer was 1.0 mm. On the cover, dimples having a shape that is the inverted shape of pimples were formed.

A clear paint including a two-component curing type polyurethane as a base material was applied to this cover to obtain a golf ball of Example 6 having a diameter of about 42.7 mm and a weight of about 45.5 g. The details of the rubber composition of the core are shown in Table 1 below. The details of the resin composition of the partial mid layer are shown in Table 2 below. In the surface of the golf ball, a region M in which the color of the partial mid layer is reflected and a region C in which the color of the core is reflected were formed. "L" values, "a" values, and "b" values of the region C and the region M were measured by the above-described method, and a color difference ΔE1 between the region C and the region M was calculated. The obtained results are shown in Table 5 below. In Table 5 below, the width h (mm) shown for Example 6 is the width of the band-shaped region where the partial mid layer is not formed and the core and the cover are in contact with each other.

Examples 8, 13, and 16 and Comparative Example 3

Golf balls of Examples 8, 13, and 16 and Comparative Example 3 were obtained in the same manner as Example 6, except the specifications of the partial mid layer were as shown in Tables 5 to 7 below. The details of the rubber composition of the core are shown in Table 1 below. The details of the resin composition of the partial mid layer are shown in Table 2 below. In Tables 5 to 7 below, the width h (mm) shown for each of Examples 8, 13, and 16 and Comparative Example 3 is the width of the band-shaped region where the partial mid layer is not formed and the core and the cover are in contact with each other.

[Evaluation Test]

The golf balls of Examples 1 to 16 and Comparative Examples 1 to 4 were hit by each of 30 golf players with each of a putter and a wedge ten times, and then evaluation was made on a 6-point scale by the 30 golf players for each of the following items (1) to (4). The golf balls were hit on the green with the putter at an arbitrary position toward a hit target. The golf balls were hit with the wedge on flat grass toward a hit target about 20 yd ahead.

(1) Visibility 1: whether regions (sizes) having different color tones can be visually recognized (Yes: 5 points to No: 0 points)

(2) Visibility 2: whether the boundary (contrast) between regions having different color tones is clear (clear: 5 points to unclear: 0 points)

(3) Ease of use: whether it is easy to address at the time of hitting and check a rotation state after hitting (easy: 5 points to difficult: 0 points)

(4) Design: whether the appearance is preferable (preferable: 5 points to not preferable: 0 points) The results obtained by categorization made according to the following criteria on the basis of the average values obtained for the respective items are shown in Tables 3 to 7 below.

S: not less than 4.0 points

A: not less than 2.5 points and less than 4.0 points

B: not less than 1.0 point and less than 2.5 points

C: less than 1.0 point

[Moldability]

For each of Examples 1 to 16 and Comparative Examples 1 to 4, 120 golf balls were molded by injection molding. The evaluation was categorized as follows on the basis of the number of golf balls for which molding failure occurred, out of the 120 golf balls. The results are shown as "ease of molding" in Tables 3 to 7 below. The molding failure means that the partial mid layer was not able to be formed at a desired position with a desired thickness.

S: 0

A: 1

B: 2

C: 3 or more

TABLE 1

| | (parts by weight) | |
|---|---|---|
| Core | R1 | R2 |
| BR-730 | 100 | 100 |
| Zinc diacrylate | 35 | 35 |
| Barium sulfate | 11 | 11 |
| Zinc oxide | 5 | 5 |
| DPDS | 0.5 | 0.5 |
| Dicumyl peroxide | 0.9 | 0.9 |
| Titanium dioxide | 5 | 5 |
| Yellow coloring agent | — | 0.2 |
| Color | White | Light brown |

The details of the compounds listed in Table 1 are as follows.

BR730: polybutadiene rubber (cis-bond content: 96% by weight) manufactured by JSR Corporation Zinc diacrylate: trade name "SANCELER SR" manufactured by SANSHIN CHEMICAL INDUSTRY CO., LTD.

Barium sulfate: trade name "Barium Sulfate BD" manufactured by Sakai Chemical Industry Co., Ltd.

Zinc oxide: trade name "Zinc Oxide" manufactured by Mitsui Mining & Smelting Co., Ltd.

DPDS: diphenyl disulfide manufactured by Sumitomo Seika Chemicals Co., Ltd.

Dicumyl peroxide: trade name "PERCUMYL D" manufactured by NOF Corporation

Titanium dioxide: trade name "TIPAQUE A-220" manufactured by ISHIHARA SANGYO KAISHA, LTD.

Yellow coloring agent: trade name "LB3A1323" manufactured by SUMIKA COLOR CO., LTD

TABLE 2

| Partial | (parts by weight) | | | | | |
|---|---|---|---|---|---|---|
| mid layer | Q1 | Q2 | Q3 | Q4 | Q5 | Q6 |
| Himilan #1555 | 47 | 47 | 47 | 47 | 47 | 47 |
| Himilan #1557 | 46 | 46 | 46 | 46 | 46 | 46 |
| TEFABLOC T3221C | 7 | 7 | 7 | 7 | 7 | 7 |
| FP113 | 1 | — | — | — | — | — |
| ZQ-14 | — | — | — | — | — | 1 |
| ZQ-17 | — | — | — | 1.2 | 1.9 | — |
| ZQ-18 | — | — | — | 0.24 | 0.1 | — |
| FP1050 | — | — | 0.3 | — | — | — |
| PBF-640 | — | — | — | — | — | 0.5 |
| PE-RM 18Q8863 RD | — | 10 | — | — | — | — |
| Titanium dioxide | — | 0.1 | 0.025 | | 0.05 | 4 |
| JF-90 | 0.2 | 0.2 | 0.2 | 0.2 | 0.2 | 0.2 |
| Shore D hardness | 57 | 57 | 57 | 57 | 57 | 57 |
| Color | Red | Pink | Light blue | Yellow green | Light yellow green | Light brown |

The details of the coloring agents listed in Table 2 are as follows.

FP113: red pigment manufactured by Ukseung Chemical Co., Ltd.

ZQ-14: orange pigment manufactured by Day-Glo Color Corp.

ZQ-17: yellow pigment manufactured by Day-Glo Color Corp.

ZQ-18: green pigment manufactured by Day-Glo Color Corp.

FP1050: blue pigment manufactured by SUMIKA COLOR CO., LTD

PBF-640: black pigment manufactured by RESINO COLOR INDUSTRY CO., LTD.

PE-RM 18Q8863 RD: pink pigment manufactured by Dainichiseika Color & Chemicals Mfg. Co., Ltd.

TABLE 3

| | | Ex. 1 | Ex. 2 | Ex. 3 |
|---|---|---|---|---|
| Area % | [%] | 71.0 | 71.0 | 71.0 |
| Core | | | | |
| Composition | [-] | R1 | R1 | R1 |
| Partial mid layer (circumferential band) | | | | |
| Number | [-] | 3 | 3 | 3 |
| Width h | [mm] | 4.0 | 4.0 | 4.0 |
| Straight line % | [%] | 300 | 300 | 300 |
| Composition | [-] | Q1 | Q2 | Q3 |
| Region C | | | | |
| L value | [-] | 78.6 | 78.6 | 78.6 |
| a value | [-] | 1.2 | 1.2 | 1.2 |
| b value | [-] | 0.8 | 0.8 | 0.8 |
| Region M | | | | |
| L value | [-] | 59.8 | 56.4 | 67.1 |
| a value | [-] | 55.6 | 39.7 | −14.3 |
| b value | [-] | 26.0 | 3.2 | −14.7 |
| Color difference ΔE1 | [-] | 62.9 | 44.5 | 24.8 |
| Color | [-] | — | — | — |

TABLE 3-continued

| | Ex. 1 | Ex. 2 | Ex. 3 |
|---|---|---|---|
| difference ΔE2 | | | |
| Evaluation results | | | |
| Visibility 1 | S | S | S |
| Visibility 2 | S | A | B |
| Ease of use | S | S | S |
| Design | A | A | A |
| Ease of molding | S | S | S |

TABLE 4

| | | Ex. 4 | | Ex. 5 | |
|---|---|---|---|---|---|
| Area % Core | [%] | 80.0 | | 80.0 | |
| Composition Partial mid layer (circumferential band) | [−] | R1 | | R1 | |
| Number | [−] | 1 | 1 | 1 | 1 |
| Width h | [mm] | 4.0 | 4.0 | 4.0 | 4.0 |
| Straight line % | [%] | 200 | | 200 | |
| Composition Region C | [−] | Q1 | Q2 | Q4 | Q5 |
| L value | [−] | 78.6 | | 78.6 | |
| a value | [−] | 1.2 | | 1.2 | |
| b value | [−] | 0.8 | | 0.8 | |
| Region M | | M1 | M2 | M1 | M2 |
| L value | [−] | 59.8 | 56.4 | 75.8 | 81.8 |
| a value | [−] | 55.6 | 39.7 | −37.1 | −30.5 |
| b value | [−] | 26.0 | 3.2 | 59.7 | 57.0 |
| Color difference ΔE1 | [−] | 62.9 | 44.5 | 70.4 | 64.6 |
| Color difference ΔE2 | [−] | 28.1 | | 9.3 | |
| Evaluation results | | | | | |
| Visibility 1 | | S | | S | |
| Visibility 2 | | S | | S | |
| Ease of use | | S | | S | |
| Design | | S | | A | |
| Ease of molding | | S | | S | |

TABLE 5

| | | Comp. Ex. 1 | Ex. 6 | Ex. 7 | Ex. 8 | Comp. Ex. 2 |
|---|---|---|---|---|---|---|
| Area % Core | [%] | 71.0 | 29.0 | 94.9 | 5.1 | 96.1 |
| Composition Partial mid layer (circumferential band) | [−] | R2 | R1 | R1 | R1 | R1 |
| Number | [−] | 3 | 3 | 2 | 2 | 1 |
| Width h | [mm] | 4.0 | 4.0 | 1.0 | 1.0 | 3.0 |
| Straight line % | [%] | 300 | 300 | 200 | 200 | 50 |
| Composition Region C | [−] | Q6 | Q1 | Q1 | Q1 | Q1 |
| L value | [−] | 78.8 | 78.6 | 78.6 | 78.6 | 78.6 |

TABLE 5-continued

| | | Comp. Ex. 1 | Ex. 6 | Ex. 7 | Ex. 8 | Comp. Ex. 2 |
|---|---|---|---|---|---|---|
| a value | [−] | −3.5 | 1.2 | 1.2 | 1.2 | 1.2 |
| b value | [−] | 14.2 | 0.8 | 0.8 | 0.8 | 0.8 |
| Region M1 | | | | | | |
| L value | [−] | 89.7 | 59.8 | 59.8 | 59.8 | 59.8 |
| a value | [−] | −1.5 | 55.6 | 55.6 | 55.6 | 55.6 |
| b value | [−] | 30.3 | 26.0 | 26.0 | 26.0 | 26.0 |
| Color difference ΔE1 | [−] | 19.6 | 62.9 | 62.9 | 62.9 | 62.9 |
| Color difference ΔE2 | [−] | — | — | — | — | — |
| Evaluation results | | | | | | |
| Visibility 1 | | S | S | B | B | C |
| Visibility 2 | | C | S | S | S | S |
| Ease of use | | A | S | S | D | A |
| Design | | B | A | A | A | A |
| Ease of molding | | S | A | S | B | S |

TABLE 6

| | | Comp. Ex. 3 | Ex. 9 | Ex. 10 | Ex. 11 | Comp. Ex. 4 |
|---|---|---|---|---|---|---|
| Area % Core | [%] | 3.9 | 89.7 | 92.3 | 94.8 | 96.9 |
| Composition Partial mid layer (circumferential band) | [−] | R1 | R1 | R1 | R1 | R1 |
| Number | [−] | 1 | 1 | 1 | 1 | 1 |
| Width h | [mm] | 3.0 | 4.0 | 6.0 | 8.0 | 8.0 |
| Straight line % | [%] | 50 | 100 | 50 | 25 | 15 |
| Composition Region C | [−] | Q1 | Q1 | Q1 | Q1 | Q1 |
| L value | [−] | 78.6 | 78.6 | 78.6 | 78.6 | 78.6 |
| a value | [−] | 1.2 | 1.2 | 1.2 | 1.2 | 1.2 |
| b value | [−] | 0.8 | 0.8 | 0.8 | 0.8 | 0.8 |
| Region M1 | | | | | | |
| L value | [−] | 59.8 | 59.8 | 59.8 | 59.8 | 59.8 |
| a value | [−] | 55.6 | 55.6 | 55.6 | 55.6 | 55.6 |
| b value | [−] | 26.0 | 26.0 | 26.0 | 26.0 | 26.0 |
| Color difference ΔE1 | [−] | 62.9 | 62.9 | 62.9 | 62.9 | 62.9 |
| Color difference ΔE2 | [−] | — | — | — | — | — |
| Evaluation results | | | | | | |
| Visibility 1 | | C | S | A | B | C |
| Visibility 2 | | S | S | S | S | S |
| Ease of use | | A | S | A | B | C |
| Design | | A | A | A | A | A |
| Ease of molding | | C | S | S | A | A |

TABLE 7

| | | Ex. 12 | Ex. 13 | Ex. 14 | Ex. 15 | Ex. 16 |
|---|---|---|---|---|---|---|
| Area % Core | [%] | 89.8 | 10.2 | 58.1 | 52.0 | 41.9 |
| Composition | [−] | R1 | R1 | R1 | R1 | R1 |

TABLE 7-continued

| | | Ex. 12 | Ex. 13 | Ex. 14 | Ex. 15 | Ex. 16 |
|---|---|---|---|---|---|---|
| Partial mid layer (circumferential band) | | | | | | |
| Number | [–] | 2 | 2 | 3 | 3 | 3 |
| Width h | [mm] | 2.0 | 2.0 | 6.0 | 7.0 | 6.0 |
| Straight line % | [%] | 200 | 200 | 300 | 300 | 300 |
| Composition Region C | [–] | Q1 | Q1 | Q1 | Q1 | Q1 |
| L value | [–] | 78.6 | 78.6 | 78.6 | 78.6 | 78.6 |
| a value | [–] | 1.2 | 1.2 | 1.2 | 1.2 | 1.2 |
| b value | [–] | 0.8 | 0.8 | 0.8 | 0.8 | 0.8 |
| Region M1 | | | | | | |
| L value | [–] | 59.8 | 59.8 | 59.8 | 59.8 | 59.8 |
| a value | [–] | 55.6 | 55.6 | 55.6 | 55.6 | 55.6 |
| b value | [–] | 26.0 | 26.0 | 26.0 | 26.0 | 26.0 |
| Color difference ΔE1 | [–] | 62.9 | 62.9 | 62.9 | 62.9 | 62.9 |
| Color difference ΔE2 | [–] | — | — | — | — | — |
| Evaluation results | | | | | | |
| Visibility 1 | | S | S | S | S | S |
| Visibility 2 | | S | S | S | S | S |
| Ease of use | | S | S | S | S | S |
| Design | | A | A | A | A | A |
| Ease of molding | | S | B | S | S | A |

In Tables 3 to 7, the area % means the ratio (%) of the area of the core in the region where the cover is directly laminated thereon to the surface area of a phantom sphere having a radius equal to the average value of the distance from the central point of the core to the surface of the core. The straight line % is the ratio (%) of the total length measured when the partial mid layer is projected onto the surface of the phantom sphere to the circumference of the great circle drawn on the surface of the phantom sphere. Since the cores of Examples 1 to 16 and Comparative Examples 1 to 4 are spheres, the phantom spheres thereof coincide with the cores. In addition, in the case of Examples 1 to 5, 7, 9 to 12, 14, and 15 and Comparative Examples 1, 2, and 4 (first embodiment), the width h means the width (mm) of each partial mid layer formed in a band shape, and, in the case of Examples 6, 8, 13, and 16 and Comparative Example 3 (second embodiment), the width h means the width (mm) of the band-shaped region where the partial mid layer is not formed and the core and the cover are in direct contact with each other.

From Tables 3 to 7, it is confirmed that in each of the golf balls of Examples 1 to 16, a region having a different color tone is formed in the ball surface due to the formation of the partial mid layer, so that a golf player easily addresses the golf ball at the time of hitting and easily checks the rotation state of the ball after hitting, by using this region as a guide. On the other hand, in Comparative Example 1 in which the color difference ΔE1 is less than 20.0, the contrast was not clear and the design was inferior. In Comparative Examples 2 and 4 in which the area (area %) of the core on which the cover is directly laminated exceeds 95.0% and in Comparative Example 3 in which the area % is less than 5.0%, it was difficult to visually recognize a region having a different color tone as a guide.

The golf ball described above can be used for playing golf on golf courses and practicing at practice ranges.

The above descriptions are merely illustrative examples, and various modifications can be made without departing from the principles of the present invention.

What is claimed is:

1. A golf ball comprising a core and a cover positioned outside the core, wherein an n-layer (n is a natural number) partial mid layer is provided between the core and the cover and has a hardness equal to a hardness of the cover, an area of the core in a region where the cover is laminated thereon is not less than 5.0% and not greater than 95.0% of a surface area of a phantom sphere having a radius equal to an average value of a distance from a central point of the core to a surface of the core, and in an outer surface of the golf ball, a color difference ΔE1 based on a CIELAB color system between a region C where the cover is directly laminated on the core and a region M where the cover is laminated on the partial mid layer is not less than 20.0.

2. The golf ball according to claim 1, wherein the area of the core in the region where the cover is laminated thereon is not less than 50.0% and not greater than 95.0% of the surface area of the phantom sphere having the radius equal to the average value of the distance from the central point of the core to the surface of the core.

3. The golf ball according to claim 1, wherein the partial mid layer is formed in a band shape along a great circle drawn on a surface of the phantom sphere or a small circle parallel to the great circle, and a total length L1 measured when the partial mid layer is projected onto the surface of the phantom sphere is not less than 25% of a circumference of the great circle drawn on the surface of the phantom sphere.

4. The golf ball according to claim 3, wherein the partial mid layer is formed in a band shape along at least two great circles drawn on the surface of the phantom sphere.

5. The golf ball according to claim 1, wherein the partial mid layer is provided such that the core and the cover are in contact with each other in a band shape along a great circle drawn on a surface of the phantom sphere or a small circle parallel to the great circle, and a total length L2 measured when a region where the core and the cover are in contact with each other is projected onto the surface of the phantom sphere is not less than 25% of a circumference of the great circle drawn on the surface of the phantom sphere.

6. The golf ball according to claim 5, wherein the partial mid layer is provided such that the core and the cover are in contact with each other in a band shape along at least two great circles drawn on the surface of the phantom sphere.

7. The golf ball according to claim 1, wherein a first partial mid layer and a second partial mid layer that have different color tones are provided between the core and the cover, and in the outer surface of the golf ball, a color difference ΔE2 based on the CIELAB color system between a region M1 where the cover is laminated on the first partial mid layer and a region M2 where the cover is laminated on the second partial mid layer is less than 20.0.

8. The golf ball according to claim 1, wherein a first partial mid layer and a second partial mid layer that have different color tones are provided between the core and the cover, and in the outer surface of the golf ball, a color difference ΔE2 based on the CIELAB color system between a region M1 where the cover is laminated on the first partial mid layer and a region M2 where the cover is laminated on the second partial mid layer is not less than 20.0.

9. The golf ball according to claim 1, wherein the core is a sphere, and the partial mid layer is disposed on a spherical surface of the core.

10. The golf ball according to claim 1, wherein the partial mid layer can be seen through the cover.

* * * * *